US009879494B2

(12) United States Patent
Bell et al.

(10) Patent No.: US 9,879,494 B2
(45) Date of Patent: Jan. 30, 2018

(54) HIGH ENERGY SEVERING TOOL WITH PRESSURE BALANCED EXPLOSIVES

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 0 days.

(21) Appl. No.: 15/256,281

(22) Filed: Sep. 2, 2016

(65) Prior Publication Data

US 2016/0369584 A1 Dec. 22, 2016

Related U.S. Application Data

(60) Division of application No. 14/858,816, filed on Sep. 18, 2015, now Pat. No. 9,435,170, which is a continuation-in-part of application No. 14/605,829, filed on Jan. 26, 2015, now Pat. No. 9,657,544, which is a continuation of application No. 14/120,409, filed on May 19, 2014, now Pat. No. 8,939,210.

(60) Provisional application No. 61/855,660, filed on May 20, 2013.

(51) Int. Cl.

| | |
|---|---|
| ***E21B 29/02*** | (2006.01) |
| ***E21B 33/124*** | (2006.01) |
| ***F42B 3/26*** | (2006.01) |

(52) U.S. Cl.

CPC ..... *E21B 29/02* (2013.01); *E21B 33/124* (2013.01)

(58) Field of Classification Search

CPC ..... E21B 29/02; F42B 3/26
USPC ..... 166/297, 55, 63
See application file for complete search history.

(56) References Cited

U.S. PATENT DOCUMENTS

| | | | | |
|---|---|---|---|---|
| 2,775,940 | A | 1/1957 | Klotz, Jr. | |
| 2,935,020 | A | 5/1960 | Howard et al. | |
| 4,184,430 | A | 1/1980 | Mock | |
| 4,286,520 | A | 9/1981 | Davis | |
| 4,290,486 | A | 9/1981 | Regalbuto | |
| 4,352,397 | A | 10/1982 | Christopher | |
| 4,378,844 | A * | 4/1983 | Parrish | E21B 29/02 102/313 |
| 4,537,255 | A | 8/1985 | Regalbuto et al. | |
| 4,998,477 | A | 3/1991 | Barker | |
| 5,159,145 | A | 10/1992 | Carisella et al. | |
| 5,780,764 | A | 7/1998 | Welch et al. | |
| 6,959,765 | B2 | 11/2005 | Bell | |
| 6,962,203 | B2 | 11/2005 | Funchess | |
| 7,073,589 | B2 | 7/2006 | Tiernan et al. | |
| 7,104,326 | B2 | 9/2006 | Grattan et al. | |
| 7,530,397 | B2 | 5/2009 | Bell | |
| 7,698,982 | B2 | 4/2010 | Bell | |
| 8,342,095 | B2 | 1/2013 | Bassett | |
| 8,939,210 | B2 * | 1/2015 | Bell | E21B 33/124 102/315 |
| 9,435,170 | B2 * | 9/2016 | Bell | E21B 33/124 |

(Continued)

*Primary Examiner* — Kenneth L Thompson

(57) ABSTRACT

A high energy pipe severing tool is arranged to align a plurality of pressure balanced explosive pellets along a unitizing central tube that is selectively separable from a tubular external housing. The explosive pellets are loaded serially in a column and in full view along the entire column as a final charging task. Detonation boosters are pre-positioned and connected to detonation cord for simultaneous detonation at opposite ends of the explosive column. Devoid of high explosive pellets during transport, the assembly may be transported with all boosters and detonation cord connected.

11 Claims, 2 Drawing Sheets

(56) References Cited

U.S. PATENT DOCUMENTS

| | | | | |
|---|---|---|---|---|
| 9,657,544 | B2 * | 5/2017 | Bell | E21B 29/02 |
| 2016/0369584 | A1 * | 12/2016 | Bell | E21B 33/124 |

* cited by examiner

HIGH ENERGY SEVERING TOOL WITH PRESSURE BALANCED EXPLOSIVES

CROSS REFERENCE TO RELATED APPLICATIONS

This patent application is a divisional application of, and claims priority to, U.S. patent application Ser. No. 14/858,816, titled "High Energy Severing Tool With Pressure Balanced Explosives," filed Sep. 18, 2015, which is a continuation-in-part application that claims priority to U.S. patent application Ser. No. 14/605,829, titled "Drill Collar Severing Tool," filed Jan. 26, 2015, which claims priority to U.S. patent application Ser. No. 14/120,409, titled "Drill Collar Severing Tool," filed May 19, 2014, which claims priority to U.S. Provisional Application Ser. No. 61/855,660, titled "Drill Collar Severing Tool," filed May 20, 2013, all of which are incorporated herein in their entireties.

STATEMENT REGARDING FEDERAL RESEARCH OR DEVELOPMENT

Not applicable.

FIELD

The present invention relates to the earthboring arts. More particularly, the present invention relates, generally, to methods and devices for severing drill pipe, casing and other massive tubular structures by the remote detonation of an explosive cutting charge.

BACKGROUND

Deep well earthboring for gas, crude petroleum, minerals and even water or steam requires tubes of massive size and wall thickness. Tubular drill strings may be suspended into a borehole that penetrates the earth's crust several miles beneath the drilling platform at the earth's surface. To further complicate matters, the borehole may be turned to a more horizontal course to follow a stratification plane.

The operational circumstances of such industrial enterprise occasionally present a driller with a catastrophe that requires him to sever his pipe string at a point deep within the wellbore. For example, a great length of wellbore sidewall may collapse against a drill string and cause the drill string to wedge tightly in the well bore. Thereafter, the wedged drill string cannot be pulled from the well bore and, in many cases, cannot even be rotated. A typical response for salvaging the borehole investment is to sever the drill string above the obstruction, withdraw the freed drill string above the obstruction, and return to the wellbore with a "fishing" tool to free and remove the wedged portion of the drill string.

The drill string weight, which is bearing on the drill bit and necessary for advancement into the earth strata, is provided by a plurality of specialty pipe joints having atypically thick annular walls. In the industry vernacular, these specialty pipe joints are characterized as "drill collars." A drill control objective is to support the drill string above the drill collars in tension. Theoretically, only the weight of the drill collars bears compressively on the drill bit. With a downhole drilling motor, which is configured for deviated bore hole drilling, the drill motor, bent sub and drill bit are positioned below the drill collars. This drill string configuration does not rotate in the borehole above the drill bit. Consequently, the drill collar section of the drill string is particularly susceptible to borehole seizures and because of the drill collar wall thickness, is also difficult to cut.

When an operational event, such as a "stuck" drill string, occurs, the driller may use wireline suspended instrumentation that is lowered within the central, drill pipe flow bore to locate and measure the depth position of the obstruction. This information may be used to thereafter position an explosive severing tool within the drill pipe flow bore.

Typically, an explosive drill pipe severing tool comprises a significant quantity, 800 to 1,500 grams (12,345 grains to 23,149 grains) for example, of high order explosive, such as RDX, HMX or HNS. The explosive powder is compacted into high density "pellets" of about 22.7 grams to about 38 grams (350 grains to 586 grains) each. The pellet density is compacted to about 1.6 gm./cm$^3$ to about 1.65 gm./cm$^3$ (404.6 grains/inch$^3$ to 417.3 grains/inch$^3$) to achieve a shock wave velocity greater than about 9144 meters/second (30,000 ft/sec), for example. A shock wave of such magnitude provides a pulse of pressure in the order of $2.8\times10^4$ MPa ($4\times10^6$ psi). It is the pressure pulse that severs the pipe.

In one form, the pellets are compacted, at a production facility, into a cylindrical shape for serial, juxtaposed loading at the jobsite as a column in a cylindrical barrel of a tool cartridge. Due to weight variations within an acceptable range of tolerance between individual pellets, the axial length of explosive pellets fluctuates within a known tolerance range.

Extreme well depth is often accompanied by extreme hydrostatic pressure. Hence, execution of the drill string severing operation may be required at hydrostatic pressures above 206.94 MPa (30,000 psi). Such high hydrostatic pressures tend to attenuate and suppress the pressure of an explosive pulse to such degree as to prevent separation.

One prior effort, by the industry, to enhance the pipe severing pressure pulse and to overcome high hydrostatic pressure suppression has been to detonate the explosive pellet column at both ends simultaneously. Theoretically, simultaneous detonations at opposite ends of the pellet column will provide a shock front from one end colliding with the shock front from the opposite end within the pellet column at the center of the column length. On collision, the pressure is multiplied, at the point of collision, by about 4 to 5 times the normal pressure cited above. To achieve this result, however, the detonation process, particularly the simultaneous firing of the detonators, must be timed precisely in order to assure collision at the center of the explosive column.

Such precise timing is typically provided by means of mild detonating fuse and special boosters. However, if fuse length is not accurately cut or problems exist in the booster/detonator connections, the collision may not be realized at all and the device will operate as a "non-colliding" tool with substantially reduced severing pressures.

The reliability of state-of-the-art severing tools is further compromised by complex assembly and arming procedures required at the well site. With those designs, laws and regulations require that explosive components (detonator, pellets, etc.) must be shipped separately from the tool body. Complete assembly must then take place at the well site under often unfavorable working conditions.

Finally, the electric detonators utilized by many state-of-the-art severing tools are vulnerable to stray electric currents and uncontrolled radio frequency (RF) energy sources, thereby further complicating the safety procedures that must be observed at the well site.

SUMMARY OF THE INVENTION

The pipe severing tool of the present invention comprises an outer housing of such outside diameter that is compatible with the drill pipe flow bore diameter intended for use. Distinctively, the housing wall is extremely thin (e.g. 0.028 in.) and vented to the surrounding exterior environment for interior/exterior pressure equalization. Accordingly, the only material limitation on the housing is sufficient wall strength to withstand the rigors of well descent.

Another consequence of equalizing the interior housing pressure with the exterior well bore pressure is the design freedom to use a thin wall metallic tube to house the main load explosive charge. Furthermore, for a given external housing diameter, a larger internal diameter is available for explosive loading and, therefore, a greater quantity of explosive per unit length of housing. Synergistically, the shock value of an explosive detonation is exponentially increased by an increased explosive quantity, often by the cube.

Vented housing exposure of the main load explosive to downhole fluids, such as water and petroleum based drilling fluids, is enabled by the use of fluid impermeable binders, such as Teflon or any other suitably hydrophobic polymer, which can be combined with formulations of HMX and other military grade explosives. Explosives of such formulations have been discovered to absorb well fluids at very low rates of deterioration. Little or no explosive energy is lost to well fluid exposures that occur in the order of an hour, which is usually more than an adequate time to accurately position a cutting tool for detonation.

The lower end of the present invention housing tube can be closed by a sliding, overlap assembly with a nose plug. The nose plug can be secured by screw threads to a tubular load rod. The housing tube upper end can be closed by a sliding, overlap assembly with a top carrier plug. However, the tubular load rod is threaded into the inside face of the top carrier plug and extends along the housing tube axis for substantially the full length of the housing tube.

A first bi-directional booster can be secured within the bore of the load rod tube at the top carrier plug. A first mild detonation cord can be housed along the length of the load rod tube bore, from the first booster to a second bi-directional booster at the nose plug end of the load rod tube. A third bi-directional booster can be secured in the top carrier plug for initiating a second mild detonation cord. The length of a second mild detonation cord can be laid in the trough of a helical flute that can be formed on the surface of a timing spool. Opposite ends of the second detonation cord can be disposed within detonation proximity of third and fourth bi-directional boosters. In a first embodiment of the invention, the first and second detonation cords are of identical length. In another embodiment of the invention, the first, second, or both detonation cords may be pre-shrunk.

A pellet of initiating explosive (i.e., booster explosive) can be positioned within a socket in the top carrier plug, between the first and third bi-directional boosters. A thin, fluid impermeable bulkhead can be used to separate the initiating explosive from the first and third bi-directional boosters, to isolate the booster pellet from the downhole well fluid environment of the main lower explosive housing.

The timing spool is a substantially cylindrical body element, which can have an axial bore and a helical surface flute about the cylindrical axis. The timing spool can be secured to the load rod by rod penetration through the axial bore of the spool. An upper axial sleeve extension from the spool body can abut the top carrier plug inside face to secure a spacial separation of the spool from the booster carrier. A lower axial sleeve extension from the spool body can support the fourth bi-directional booster and can serve as a limit stop for a stack of washer-shaped primary explosive pellets, which can be aligned along the length of the load rod. A coil spring can be compressed between an inside face of the nose plug and a terminal pellet in the column of the main load explosive to bias the column tightly against the lower sleeve extension.

Those of skill in the art of oilfield explosives will appreciate a characteristic of the invention that allows the bi-directional boosters and detonation cord to be transported while assembled with the housing tube structure, as a unit, by traditional carriers. The main load explosive material and the explosion initiating booster pellet are removed from the assembly for isolated transport. The housing tube, bi-directional boosters and detonation cord, in operational assembly, are in compliance with standard transport regulations. At the site of use, the main load explosive pellets and initiating booster may be quickly inserted.

The invention assembly and loading sequence includes a separation of the housing tube and nose plug, as a unit, from the booster carrier and load rod. Measured quantities of military grade explosive material, such as HMX, RDX and HNS that can be blended with a fluid impervious binder of polymer material that inhibits fluid penetration of, or absorption by, the explosive material, is pressed into annular disc shaped pellets that can have a central aperture with an inside diameter that can be slightly greater than the load rod diameter. The outside diameter of the pellets corresponds to the inside diameter of the housing tube. A multiplicity of such pellets can be aligned in a column along the length of the load rod, with the first pellet engaging the distal end of the lower axial sleeve of the timing spool and in detonation proximity with the fourth bi-directional booster.

With the predetermined number of main load explosive pellets in place along the load rod length, the housing tube and nose plug are repositioned over the column of the main load pellets. Threading the nose plug onto the load rod compresses a coil spring against the lower-most main load pellet. The thin wall housing tube remains free of axial compression.

An embodiment of the present invention includes an apparatus for severing a length of pipe, which can comprise a tubular housing having an internal bore and a plurality of bi-directional boosters, and one or more vents in the housing to substantially equalize fluid pressure within the bore with fluid pressure outside of the tubular housing. The apparatus can include a first detonation cord that can have a first length between a first bi-directional booster and a second bi-directional booster of said plurality of bi-directional boosters. In addition, the apparatus can comprise a second detonation cord that can have a first length between a third bi-directional booster and a fourth bi-directional booster of said plurality of bi-directional boosters. The embodiment of the apparatus can include a main load explosive material, positioned in the tubular housing and located between the second bi-directional booster and the fourth bi-directional booster of the plurality of bi-directional boosters; a fluid impermeable material that can be mixed with the main load explosive material; and an initiating booster explosive that can be used for simultaneously initiating the first and the third bi-directional boosters of the plurality of-bidirectional boosters.

In an embodiment, the main load explosive material can be pressed into a plurality of annular pellets, and the plurality of annular pellets can be compressed to a pressure corresponding to an expected detonation environment pressure. Corresponding to the expected detonation environment pressure may entail either matching or exceeding the expected detonation environment pressure or, alternatively, if the expected detonation environment pressure is in excess of the pressure required to compress the explosive material to its maximum possible density, simply applying sufficient pressure to achieve said maximum possible density.

In an embodiment of the apparatus, the tubular housing can further comprise a tubular loading rod that can be used for penetrating a central aperture of the plurality of annular pellets. The annular pellets can be aligned along the tubular loading rod, between the second and the fourth of the plurality of bi-directional boosters. In an embodiment, the fourth of the plurality of bi-directional boosters can be disposed within detonation proximity of the main load explosive material.

In an embodiment of the apparatus for severing a length of pipe, the tubular loading rod can comprise a central bore, and the first bi-directional booster and the second bi-directional booster of the plurality of bi-directional boosters can be disposed within the central bore, at respectively opposite ends of the first detonation cord. In an embodiment, a first resilient bias can be positioned within said tubular loading rod, between a second end plug and the second of the plurality of bi-directional boosters, and the first resilient bias can bias the first bi-directional booster and the second bi-directional booster and the first detonation cord toward the pellet of initiating booster explosive.

In an embodiment, the third bi-directional booster and the fourth bi-directional booster of the plurality of bi-directional boosters can be disposed at respectively opposite ends of the second detonation cord. An intermediate portion of the second detonation cord can be located between the third and the fourth of the plurality of bi-directional boosters, wherein the intermediate portion is wound about a timing spool. In an embodiment, the timing spool can comprise a cylindrical body and a helical flute formed on the surface of the body, about an axis thereof.

In an embodiment of the present invention, the apparatus can further comprise a first end plug and a second end plug for enclosing an internal bore between opposite ends of the tubular housing. The first end plug can comprise an initiating booster cavity, wherein the initiating booster cavity can hold the initiating booster explosive. The apparatus can further comprise a firing head that can be secured to the first end plug, and the firing head can comprise a detonator that can be disposed within detonation proximity of the initiating booster explosive. In an embodiment, a second resilient bias can be positioned between the second end plug and the plurality of annular pellets.

In an embodiment, the tubular loading rod can comprise a structural wall surrounding or about the central bore, wherein the structural wall can be penetrated by an aperture, for example, between the second bi-directional booster and a portion of the plurality of annular pellets.

An embodiment of the present invention includes a method of severing a pipe, which comprises the steps of enclosing opposite ends of a tubular housing, venting the tubular housing to substantially equalize fluid pressure within the tubular housing to the fluid pressure outside of the tubular housing, and placing a first bi-directional booster, a second bi-directional booster, a third bi-directional booster, and a fourth bi-directional booster within the tubular housing. The steps of the method can continue by connecting a first detonation cord with a first length between the first bi-directional booster and the second bi-directional booster. In this embodiment, the method can include connecting a second detonation cord with a first length between the third bi-directional booster and the fourth bi-directional booster. The steps of the method can further continue by combining a main load explosive material and a fluid impermeable material into a mixture, and loading the mixture into the tubular housing, between the second and fourth bi-directional boosters. The method steps can conclude by positioning the tubular housing and the mixture inside of a pipe, and simultaneously initiating the ignition of the second and the fourth bi-directional boosters.

In an embodiment, the steps of the method can include the step of pressing the mixture into a plurality of annular pellets, wherein the step of pressing the mixture further comprises compressing the plurality of annular pellets to a pressure corresponding to an expected detonation environment. In an embodiment, the step of loading the mixture into the tubular housing can further comprise aligning the plurality of annular pellets in a column between the second bi-directional booster and the fourth bi-directional booster of the plurality of bi-directional boosters.

In an embodiment, the method can further include the step of penetrating a central aperture of the plurality of annular pellets with a tubular loading rod, wherein the step of placing the first bi-directional booster, the second bi-directional booster, the third bi-directional booster, and the fourth bi-directional booster, of the plurality of bi-directional boosters, can further include placing the first bi-directional booster of the plurality of bi-directional boosters within one end of a central bore of the tubular loading rod and placing the second bi-directional booster of the plurality of bi-directional boosters within the central bore at an opposite end of the tubular loading rod.

The method steps of placing the first, the second, the third, and the fourth of the plurality of bi-directional boosters can further include placing the first bi-directional booster of the plurality of bi-directional boosters within detonation proximity of an initiating booster explosive, and in the same or another embodiment, placing the third bi-directional booster of the plurality of bi-directional boosters within detonation proximity of said initiating booster explosive.

In an embodiment, the step of connecting a second detonation cord can include wrapping the second detonation cord about a timing spool, and positioning opposite ends of the second detonation cord in detonation proximity of the third bi-directional booster and the fourth bi-directional booster, of the plurality of bi-directional boosters.

Other embodiments of the present invention can include an apparatus for severing a length of pipe, wherein the apparatus can comprise a tubular housing that includes an internal bore and at least one vent, wherein the at least one vent can be usable for equalizing fluid pressure within the internal bore to fluid pressure outside of the tubular housing; and a first end cap, positioned on a first distal end of the tubular housing, that is usable to close a first distal end of the internal bore, with an initiating booster explosive located in the first end cap. The apparatus can further comprise a second end cap positioned on a second distal end of the tubular housing and usable to close a second distal end of the internal bore. In addition, the apparatus can include a loading tube positioned within the tubular housing and connecting the first end cap with the second end cap, wherein the loading tube comprises a central bore and extends through a timing spool, and wherein a first bi-directional booster is positioned within the central bore of the loading tube, proximate to the first end cap and in detonation proximity to the initiating booster explosive. In this embodiment of the apparatus, a second bi-directional booster can be positioned within the central bore of the loading tube and proximate to the second end cap, and a first detonation cord can be positioned within the loading tube, between the first and the second bi-directional boosters. In this embodiment, a second detonation cord can have a first length between the third bi-directional booster and the initiating explosive booster, and a main load explosive material can be positioned within the tubular housing, between the second end cap and the third bi-directional booster, for ignition and use in severing the length of a pipe or other tubular. In an embodiment, the main load explosive can be pressed into a plurality of annular pellets, and the loading tube can extend through the plurality of annular pellets. The annular pellets can be aligned along the loading tube, between the second bi-directional booster and the third bi-directional booster.

In an embodiment, the apparatus can include a second detonation cord that is helically wound about the timing spool body. The second detonation cord can extend from the bi-directional booster, through the timing spool, to connect to the initiating booster explosive through an aperture in the first end cap.

An alternative embodiment of the present invention eliminates the use of the timing spool and a second detonation cord. Progression of a detonation front along the column of the main load explosive pellets may be retarded by a select number of timing discs that can be fabricated from a low impedance material, such as Teflon or other suitable polymer, that can be positioned along the load rod, between the adjacent main load explosive pellets. Similar results can be obtained by blending the formulation of the main load explosive with micro bubbles, which can reduce the detonation front velocity.

Such an alternate embodiment can include an apparatus for severing a length of pipe that includes a tubular housing that includes an internal bore and at least one vent, wherein the at least one vent can be usable for equalizing fluid pressure within the internal bore to fluid pressure outside of the tubular housing; and a first end cap, positioned on a first distal end of the tubular housing, that is usable to close a first distal end of the internal bore, with an initiating booster explosive located in the first end cap. The apparatus can further comprise a second end cap positioned on a second distal end of the tubular housing and usable to close a second distal end of the internal bore. In addition, the apparatus can include a loading tube positioned within the tubular housing, between the first end cap and the second end cap. The loading tube can include a first bi-directional booster positioned within the loading tube and in detonation proximity to the initiating booster explosive, a second bi-directional booster positioned within the loading tube and proximate to the second end cap, and a detonation cord positioned within the loading tube and between the first bi-directional booster and the second bi-directional booster. The detonation cord can provide a detonation ignition time interval between ignition of the first bi-directional booster and ignition of the second bi-directional booster. A third bi-directional booster can be located within the first end cap and in detonation proximity to the initiating booster explosive. In this embodiment, a blend of explosive material and fluid impermeable material can be compressed into a plurality of annular explosive pellets, and a first column of the plurality of annular explosive pellets can comprise a first quantity of explosive material aligned along the loading tube, from the second bi-directional booster toward a detonation wave collision point. A second column of the plurality of annular explosive pellets can comprise the first quantity of explosive material aligned along the loading tube, from a third bi-directional booster toward the detonation wave collision point, and a detonation wave retarding material that can be usable for retarding the progress of a detonation wave along the second column by a time interval corresponding to a detonation wave time interval along the first column.

In an embodiment, the apparatus can include a fluid barrier positioned in the first end cap, between the tubular housing and the initiating booster explosive, to isolate the initiating booster explosive from fluid within the housing. The detonation wave retarding material can comprise one or more annular discs of polymer material that can be distributed among the plurality of annular explosive pellets, wherein the polymer material can be Teflon. In an embodiment, the detonation wave retarding material can comprise glass micro-balloons that can be blended with the explosive material and the fluid impermeable material.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

Figure 1:
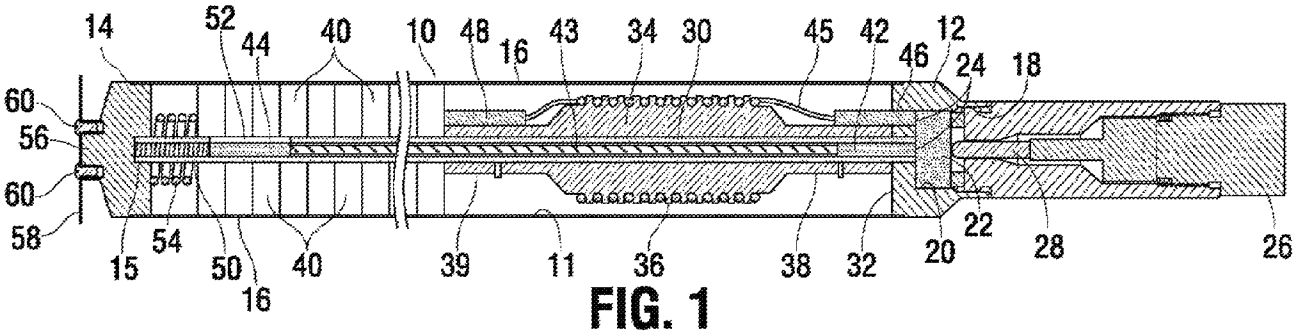
FIG. 1 is a sectional view of the present invention as assembled for operation.

Before explaining selected embodiments of the present invention in detail, it is to be understood that the present invention is not limited to the particular embodiments described herein and that the present invention can be practiced or carried out in various ways. As used herein, the terms "up" and "down", "upper" and "lower", "upwardly" and downwardly", "upstream" and "downstream"; "above" and "below"; and other like terms, indicating relative positions above or below a given point or element, are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Embodiments of the present invention relate, generally, to methods and devices for severing drill pipe, casing and other massive tubular structures by the remote detonation of an explosive cutting charge. Referring to the FIG. 1, a cross-sectional view of the present invention is shown that includes a tubular outer housing 10, which is secured at an upper distal end to a top carrier plug 12. The outer housing 10 has an internal bore 11 that is closed at its lower end by a nose plug 14 (also shown in FIG. 2). Notably, the housing 10 interior is vented to the exterior by the use of tubular wall apertures 16.

The upper end of the housing bore 11 is closed by a firing assembly, which can comprise a top carrier plug 12 and a firing head 26, as shown. An internal cavity 20 in the top carrier plug 12 is formed to receive a pellet of initiating booster explosive 22. Thin, fluid pressure bulkheads 24 are shown, for example as fluid barriers, that can be positioned across the initiating booster cavity bottom to isolate the initiating booster explosive 22 from the well fluid and pressure environment that can occupy the interior bore of the housing 10 due to the apertures 16 (i.e., vents).

The upper end of the top carrier plug 12 can include an internally threaded socket 18, as shown in FIG. 1. The socket 18 can receive the firing head 26 that positions a detonator 28 in detonation proximity of the initiating booster explosive 22. Detonation proximity is that distance between a particular detonator and a particular receptor explosive within which ignition of the detonator will initiate a detonation of the receptor explosive.

The loading rod 30 can be secured to the top carrier plug 12 by threads, and the loading rod 30 can project from the inside face 32 of the plug 12, along the housing 10 axis. The opposite distal end of the loading rod 30 can be threaded into a socket 15 in the nose plug 14.

The upper end of the loading rod 30 can penetrate an axial bore through and along the length of a generally cylindrical timing spool body 34. The cylindrical surface of the timing spool body 34 can be formed with a helically wound flute 36. Opposite ends of the timing spool body 34 can be formed as reduced outside diameter sleeves 38 and 39. The upper sleeve 38 can be usable for spacing the spool body 34 from the top carrier plug 12. The lower sleeve 39 can be usable for spacing the spool body 34 from the uppermost main load explosive pellet 40 and can provide structural support for a bi-directional booster 48. Bi-directional boosters 42, 44, 46, 48 may additionally be self-supporting through compression prior to loading within housing 10 or loading rod 30.

As shown in FIG. 1, the length of a first detonation cord 43 is housed within the central bore of the loading rod 30 and links the first bi-directional booster 42 with the second bi-directional booster 44. The first bi-directional booster 42 is housed within the upper end of the bore of the loading rod 30 and within detonation proximity of the initiating booster explosive 22. The second bi-directional booster 44 is housed near the lower distal end of the bore of the loading rod 30 and against the resilient bias of a coil spring 50, also positioned within the bore of the loading rod 30. The coil spring 50 maintains a compressive contact between the first and second bi-directional boosters and the first detonation cord 43. A slit is cut into the structural wall of the loading rod 30, adjacent the second bi-directional booster 44, to provide an ignition initiation window 52 between the second bi-directional booster 44 and the adjacent main load explosive pellets 40. A larger coil spring 54 surrounds the lower end of the load rod 30 to apply a resilient bias between the nose plug 14 and the end-most main load explosive pellet 40.

In the embodiment shown in FIG. 1, a third bi-directional booster 46 can be secured within an aperture 13 (shown in FIG. 3) that penetrates the transverse wall 32 (i.e., inside face wall) of the top carrier plug 12 to position the third bi-directional booster 46 in detonation proximity of the initiating explosive 22. As further shown in the embodiment of the present invention shown in FIG. 1, a fourth bi-directional booster 48 can be secured to the lower timing spool sleeve 39. The third and fourth bi-directional boosters 46 and 48 can be linked by a second mild detonation cord 45, which has substantially the same length as the first mild detonating cord 43. However, the intermediate length of the second detonation cord 45 is wound about the flutes 36 on the timing spool 34 surface.

Figure 2:
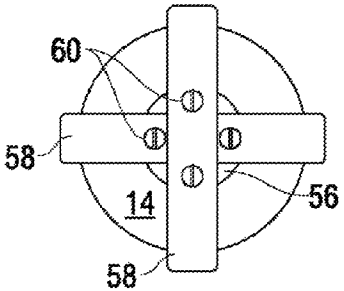
FIG. 2 is a lower end view of FIG. 1.

The distal end of the nose plug 14 can be tapered back from a central boss 56 to provide flexure clearance for the two or more centralizers 58, as shown by FIG. 2, which are used for centralizing the high energy severing tool within a tubular and/or the wellbore. Each centralizer 58 can be secured by a pair of fasteners, such as machine screws 60, to provide resistance against rotation of the centralizers about the tool axis.

It should be understood that the tool assembly, as described above, may be safely transported by traditional media with the bi-directional boosters 42, 44, 46, and 48 in place and the detonation cords 43 and 45 positioned between the respective bi-directional boosters. However, in transport, no main load explosive material 40 and/or initiating booster pellets 22 are present within the housing 10 assembly.

Annular pellets of main load explosive material 40 can be formed from explosive material, such as RDX, HNX or HNS, which is mixed with a fluid impermeable material, such as Teflon or other polymer as a binder. Approximately 22.7 gms. to 38 gms. (350 grains to 586 grains) of such explosive material is pressed into an annular disc of an outside diameter that is less than the inside diameter of the housing 10 and a central aperture diameter that is greater than the outside diameter of the loading rod 30. Preferably, the annulus shaped pellets are compacted to a pressure corresponding to an expected detonation environment pressure.

As previously stated, the apparatus may be safely transported to the well site of use with the bi-directional boosters and the detonation cord in place. The main load pellets 40 and initiation booster explosive pellet 22 are transported separately.

Final assembly of the complete severing tool normally occurs on the drilling rig floor at the well site. The housing tube 10 and nose plug 14, as an integral unit, are withdrawn from the top carrier 12 and loading rod 30, The required number or plurality of main load pellets 40 can be aligned in a column with the pellet central aperture around the loading rod 30, and the first pellet abutting the lower spool sleeve 39. Then, the threaded socket 15 of the nose plug 14 can be screwed onto the lower distal end of the loading rod 30, thereby compressing the load rod spring 50 against the second bi-directional booster 44 and the outer larger spring 54 against the main load explosive pellet 40 assembly.

With the main load explosive pellets aligned in a column over the loading rod 30, the housing 10 can be secured to the top carrier plug 12. Next, the pellet of initiating booster explosive 22 can be inserted into the internal cavity 20, and the firing head 26 can be screwed into the socket 18 of the top carrier plug 12 to position the detonator 28 within detonation proximity of the pellet of initiating booster explosive 22.

As assembled, the tool can be secured to the end of a suspension string and lowered into the well bore, along the well pipe flow bore. When positioned at the required location, the initiating booster explosive 22 is detonated to start a pair of parallel ignition sequences that meet at the central collision point.

Figure 3:
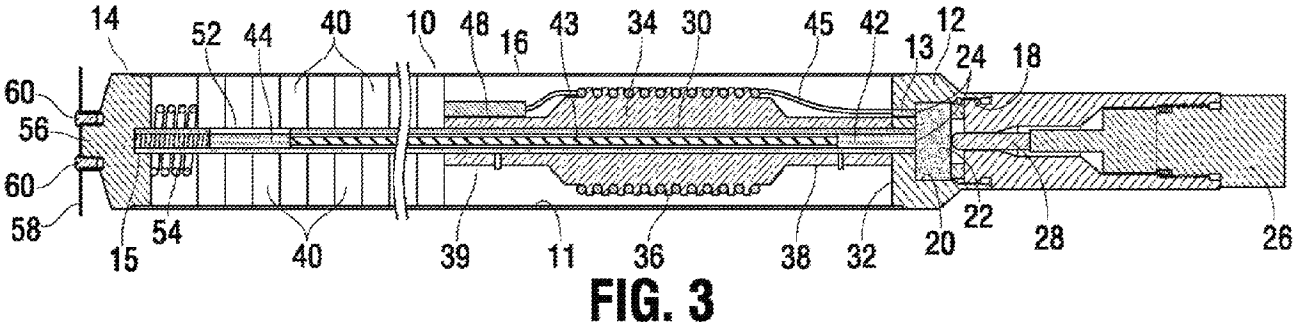
FIG. 3 is a sectional view of the second embodiment of the invention.

The second embodiment of the invention, illustrated by FIG. 3, differs from FIG. 1 mainly by the omission of the third bi-directional booster 46. As shown in FIG. 3, the first detonation cord 43 is positioned between the first bi-directional booster 42 and the second bi-directional booster 44, and the second detonation cord 45 connects the fourth bi-directional booster 48 to the initiating booster explosive 22. As shown, the upper distal end of the second detonation cord 45 is secured within an aperture 13, thereby positioning the end of the second detonation cord 45 within detonation proximity of the pellet of initiating booster explosive 22. The intermediate length of the second detonation cord 45, between the aperture 13 and the bi-directional booster 48, is wrapped about the flutes 36 of the timing spool body 34.

Figure 4:
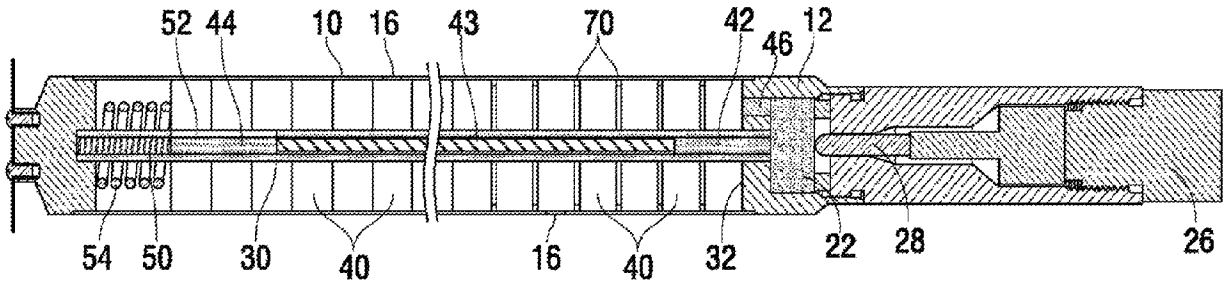
FIG. 4 is a sectional view of the third embodiment of the invention.

A third embodiment of the invention, as shown by FIG. 4, omits the use of a timing spool body 34, a second detonation cord 45, and a fourth bi-directional booster 48 by inserting timing washers 70 between explosive pellets 40 in the upper portion of the main load explosive column. As shown, this embodiment includes a detonation cord 43 positioned between the first bi-directional booster 42 and the second bi-directional booster 44, with the third bi-directional booster positioned proximate to the initiating booster explosive 22.

In this third embodiment of the invention, a first column of main load explosive pellets 40, collectively comprising a predetermined quantity of explosive material and a fluid impermeable material, is aligned along the loading rod 30, between the second bi-directional booster 44 and a detonation wave collision point. A second column of main load explosive pellets 40, also collectively comprising the predetermined quantity of explosive material, is aligned along said loading rod 30, from detonation proximity with the third bi-directional booster 46 to said detonation wave collision point. However, also progressing along the second column from the third bi-directional booster 46 toward said detonation wave collision point is a number of pellet shaped timing washers 70 that are distributed among the main load explosive pellets 40. Each timing washer 70 retards the progress of the explosive shock front as it advances along the second explosive column from the third bi-directional booster 46 toward the detonation wave collision point. Suitable fabrication materials for such timing washers include numerous polymers, such as Teflon. The total elapsed time between detonation of the first bi-directional booster 48 and the second bi-directional booster 44 corresponds to the total retardation time that must be incurred by the timing washers 70. As many of the timing washers 70 are provided in the second main load explosive column as is necessary to substantially match the time interval for a detonation wave to travel along the first detonation cord 43, from the first bi-directional booster 42 to the second bi-directional booster 44, so the two primary explosive shock waves, arising from the same quantity of explosive material in both columns, will collide at the detonation wave collision point.

Figure 5:
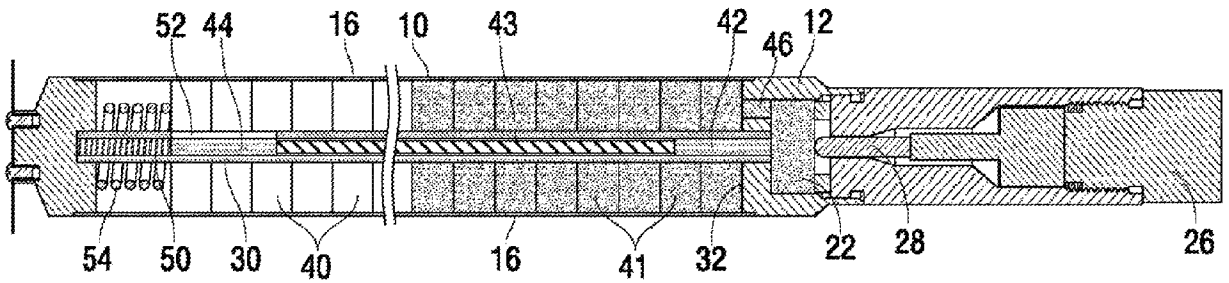
FIG. 5 is a sectional view of the fourth embodiment of the invention.

As a variant of FIG. 4, the embodiment shown in FIG. 5 provides glass micro-bubbles that can be blended with the explosive material of the second column along with the fluid impermeable material. Such micro-bubbles are known to retard the shock wave advance through explosive material. In this example, the micro-bubble blended pellets 41 comprise the second column of main load explosive. As in the second example, however, the same quantity of explosive material is provided for both columns.

Figure 6:
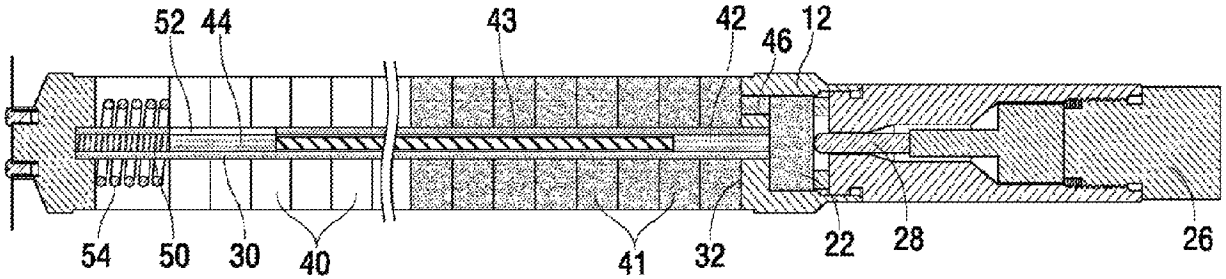
FIG. 6 is a sectional view of a fifth embodiment of the invention.

As a further variant, the embodiments depicted in FIGS. 4-5 may be constructed without an outer housing. FIG. 6 depicts a variant of FIG. 5, with the housing and corresponding housing apertures removed from the apparatus such that the compressed pellets are directly exposed to the well environment. It can be appreciated by those of ordinary skill in the art that the embodiment in FIG. 4 may be similarly constructed without a housing.

Numerous modifications and variations may be made of the structures and methods described and illustrated herein without departing from the scope and spirit of the invention disclosed. Accordingly, it should be understood that the embodiments described and illustrated herein are only representative of the invention and are not to be considered as limitations upon the invention as hereafter claimed.

The invention claimed is:

1. An apparatus for severing a length of pipe comprising:

a tubular housing having an internal bore and a plurality of bi-directional boosters;

one or more vents in said tubular housing to substantially equalize fluid pressure within said internal bore with fluid pressure outside of said tubular housing;

a first detonation cord having a first length between a first bi-directional booster and a second bi-directional booster of said plurality of bi-directional boosters;

a second detonation cord having a first length between an initiating booster for simultaneously initiating said first and second detonation cords and a third bidirectional booster of said plurality of bi-directional boosters;

a main load explosive material in said tubular housing located between said second bi-directional booster and said third bi-directional booster of said plurality of bi-directional boosters; and a fluid impermeable material mixed with said main load explosive material.

2. The apparatus of claim 1, further comprising a fourth bi-directional booster between the second detonation cord and the initiating booster.

3. The apparatus of claim 1, wherein said main load explosive material is pressed into a plurality of annular pellets.

4. The apparatus of claim 3, wherein said plurality of annular pellets are compressed to a pressure corresponding to an expected detonation environment pressure.

5. The apparatus of claim 3, wherein said tubular housing further comprises a tubular loading rod for penetrating a central aperture of said plurality of annular pellets.

6. The apparatus of claim 5, wherein said tubular loading rod comprises a central bore, and wherein said first bi-directional booster and said second bi-directional booster of said plurality of bi-directional boosters are disposed within said central bore at respectively opposite ends of said first detonation cord.

7. The apparatus of claim 1, wherein an intermediate portion of said second detonation cord is wound about a timing spool.

8. The apparatus of claim 7, wherein said timing spool comprises a cylindrical body and a helical flute formed on the surface of said body about an axis thereof.

9. The apparatus of claim 6, further comprising a first end plug and a second end plug for enclosing said central bore between opposite ends of the tubular housing.

10. The apparatus of claim 9, wherein the first end plug further comprises an initiating booster cavity, wherein said initiating booster cavity holds said initiating booster explosive.

11. The apparatus of claim 10, further comprising a first resilient bias positioned within said tubular loading rod between said second end plug and said second bi-directional booster of the plurality of bi-directional boosters, and a second resilient bias positioned between said second end plug and said plurality of annular pellets.

* * * * *